United States Patent [19]

Sédat

[11] 4,366,010

[45] Dec. 28, 1982

[54] SMOKE-PRODUCING PYROTECHNIC COMPOSITION AND ITS APPLICATION

[76] Inventor: Georges A. Sédat, 16h rue Jonyh-Prirrugue, 83700 St. Raphael, France

[21] Appl. No.: 169,204

[22] Filed: Jul. 15, 1980

Related U.S. Application Data

[63] Continuation-in-part of Ser. No. 944,564, Sep. 21, 1978, abandoned.

[51] Int. Cl.[3] ..... C06B 45/10

[52] U.S. Cl. ..... 149/19.6; 149/19.1; 149/117

[58] Field of Search ..... 149/117, 19.4, 19.6, 149/19.1

[56] References Cited

U.S. PATENT DOCUMENTS

| | | | |
|---|---|---|---|
| 3,004,840 | 10/1961 | Pruitt et al. | 149/19.4 |
| 3,305,523 | 3/1967 | Burnside | 149/19.6 |
| 3,454,436 | 7/1969 | Bedell | 149/19.6 |
| 3,523,840 | 8/1970 | Bedell | 149/19.6 |
| 3,664,898 | 5/1972 | Taylor et al. | 149/45 |
| 3,690,971 | 9/1972 | Gunderky et al. | 149/19.6 |
| 4,111,728 | 9/1978 | Ramnarace | 149/19.6 |

*Primary Examiner*—Edward A. Miller

*Attorney, Agent, or Firm*—Stevens, Davis, Miller & Mosher

[57] ABSTRACT

The invention relates to a smoke-producing pyrotechnic composition and its applications.

The composition comprises the following main components:

at least one first compound selected from the group consisting of potassium or sodium chlorate;

at least one second compound selected from the group consisting of guanidine nitrate;

metallic oxides;

at least one epoxyaliphatic resin, whether or not plasticized; and at least one sublimable organic coloring substance.

It is used primarily in pyrotechnics, in particular for the production of colored smokes.

17 Claims, No Drawings

SMOKE-PRODUCING PYROTECHNIC COMPOSITION AND ITS APPLICATION

This application is a continuation-in-part of copending application Ser. No. 944,564 filed Sept. 21, 1978, now abandoned.

BACKGROUND OF THE INVENTION

This invention relates to a smoke-producing pyrotechnic composition and its applications.

The field of art is that of pyrotechnics and more particularly means for producing colored smokes.

A great deal of research has been undertaken in this field in order to obtain an efficient result from such compositions, that is to say to obtain the sublimation of the coloring substance contained in the composition which, upon condensation in the atmosphere, produces the effect of colored smoke.

It is known that the following problems arise;

the coloring substance is chemically unstable and must be able to be preserved in its greater part, the resins must be combustible at low temperature in order to make the sublimation of the coloring substance easier;

the residues coming from this combustion must not be too abundant or compact, as in such case the "occlusion" of the coloring substance is brought about;

the coloring substances have active chemical functions capable of inhibiting the polymerization of numerous resins.

The purpose which is to be achieved is therefore a rapid sublimation of the coloring substance at low temperature, at which temperature the composition is combustible without leaving excessively compact or abundant residues.

Composition have been proposed that contain binders of plastic in order to improve the coherence of the charge and form a consolidated mass. They have never actually been used as the colored-smoke effect is generally poor.

Other compositions have the drawback of burning at temperatures which are too high or leave too many carbonaceous residues which are impermeable to the gases, causing the destruction of the components and therefore poor effectiveness in the production of colored smokes. Another drawback may be the rapid ascent of the smoke which then does not last sufficiently long.

SUMMARY OF THE INVENTION

The present invention proposes solving these problems by means of a castable smoke-producing pyrotechnical composition having a colored smoke which burns at a temperature of from 190° to 300° C., said composition comprises:

a synthetic resin that decomposes at a temperature between about 190° and 300° C.;

an oxidizing system formed by the combination of potassium or sodium chlorate and guanidine nitrate, the two of which react as oxidizers simultaneously from about 190° C. to 300° C., this combination having properties which are far superior to those of the two components taken individually; and an organic coloring substance that is sublimable at this same temperature.

DISCUSSION OF THE PRIOR ART

French Patent Application No. 2,153,431 relates to compositions which contain among their components zinc oxide and ammonium perchlorate. This is not the object of the present invention.

U.S. Pat. No. 2,409,111 refers to a compacted and therefore noncastable composition which contains a "cold explosive" such as ammonium nitrate or a derivative of guanidine, associated with black powder and possibly with potassium nitrate or some other oxidizing agent. This possible combination was not explicitly described or exemplified. In view of the incompatibility of certain guanidine derivatives with certain oxidants (for example amines/chlorates) and their very poor stability (they decompose at a temperature much lower than that of the reaction of the other components and do not permit one to obtain either a storable product or a homogeneous composition which produces a quality smoke upon its combustion), said patent validly describes only the use of a cold explosive for compacted compositions. Furthermore the composition does not contain a synthetic resin which decomposes between 190° and 300° C.

U.S. Pat. No. 3,542,610 refers to an oil-mist pyrotechnical composition containing, in particular, an oil, an aminoguanidine salt and an oxidizing agent. This is not a composition which produces a colored smoke and the selection of the components for the obtaining of an oil mist without igniting. It is not comparable to that of the present invention which is directed to the rapid sublimation of the coloring substance at a low temperature, the decomposition of the resin taking place at the same time as the combustion of the oxidizing system, without occlusion of the coloring substance.

Furthermore it is to be noted that aminoguanidine salts (even the unstable nitrate) are not equivalents of guanidine nitrate. Additionally, the man skilled in the art is acquainted with the incompatibility which exists between chlorates and amines; this is undoubtedly the reason why no example of such a combination is reported.

French Patent No. 1,424,485 refers to a composition which contains, in particular, a semi-fossil resin, manganese dioxide, ammonium perchlorate, and nitroguanidine. This is not a colored-smoke composition. It should be noted that nitroguanidine is not guanidine nitrate and cannot be considered the equivalent thereof. Furthermore, the aromatic oils liberated upon the combustion of the semi-fossil resins produce a mist, which will be undesirable in the present invention the object of which is not to serve as a mask but rather the contrary. The numerous residues obtained are also a drawback which has been reduced by the present invention.

U.S. Pat. No. 3,690,971 describes a pyrotechnic composition that contains a dye precursor capable of reacting in situ to yield a sublimable dye which will recondense as a colored smoke and a heat-producing composition that can generate sufficient heat to react the dye precursor to yield the sublimable dye and to sublime same without substantial destruction. The patent at column 3, lines 57 to 61 indicates that the pyrotechnic composition is one that is heated at a temperature between 600° and 1000° C. There is no contemplation in this patent of using guanidine nitrate in any fashion and the patent contains no disclosure that would suggest that the resin used therein has to have a decomposition temperature between 190° and 300° C.

EMBODIMENTS OF THE INVENTION

One embodiment contemplates incorporating in the oxidizing system at least one compound selected from the group of metallic oxides and preferably copper, ferric, nickel and manganese oxides, which therefore constitute catalysts.

An epoxyaliphatic resin without solvent of preparation is added to the oxidizing system. This resin is preferably the product of the condensation of epoxypropanol with an aliphatic polyalcohol, preferably propanetriol (glycerol) or ethanediol (glycol) or the product of the polymerization of a diglycidic ether of an aliphatic dialcohol, preferably the diglycidic ether of 1,4 butanediol, the polymerization agent being an aminated hardener.

The epoxyaliphatic resin is preferably plasticized by an organic agent such as glycerol or the diglycidic ether of 1,4 butanediol, this agent having been added before polymerization.

A further embodiment contemplates the incorporating of about 10 to about 25% of potassium or sodium chlorate, about 10 to about 30% of guanidine nitrate, about 10 to about 35% of a synthetic epoxyaliphatic resin that decomposes at a temperature between 190° and 300° C. and is the condensation reaction product of epoxypropanol and an aliphatic polyalcohol, preferably propanetriol or ethanediol, said epoxyaliphatic resin being associated with the diglycidic ether of 1,4 butanediol before polymerization and combined with an aminated hardener, up to about 15% of an organic plasticizer, about 25 to about 50% of a sublimable organic coloring substance, and up to about 5% of at least one metallic oxide, the percentages being by weight of component based upon the total weight of said composition all these components are selected to react and burn at a temperature of 190° to 300 ° C.

Another component of the composition which forms the object of the invention is the sublimable organic coloring substance.

Furthermore, it is an object of the invention to state a process for the sublimation of a coloring substance in a castable smoke-producing pyrotechnic composition comprising a synthetic resin, an organic coloring substance, and an oxidizing agent comprising undertaking sublimation at a temperature between 190° and 300° C. by reacting a mixture containing a synthetic resin that decomposes between 190° and 300° C., an organic coloring substance that sublimates at 190° to 300° C., and an oxidizing agent formed by combining (1) potassium chlorate or sodium chlorate and (2) guanidine nitrate.

The result of the invention is a new product formed of a castable smoke-producing pyrotechnic composition having a colored smoke, and its applications.

The main advantage of the invention is the combustion of this composition at low temperature in the range of 190° to 300° C. and its ability to permit easy sublimation of the coloring substance.

The secondary advantages resulting therefrom are the non-destruction of the coloring substance at the temperature of 190° to 300° C. at which one operates, and a quality and quantity of smoke emitted per unit of weight which are superior to the customary performance.

Other advantages are:

combustion without abundance or compactness of residues which in prior techniques caused the occlusion of the coloring substance.

the uniformity of operation, assuring a longlasting fire of at least 5 to 10 minutes.

the easy decomposition of the binder.

Summarizing, from such a composition containing a suitably selected coloring substance there is obtained a non-degraded colored smoke with a high yield per unit of weight, without the simultaneous giving off of grey fumes.

Such a composition is employed in pyrotechnics in particular for the production of colored smokes.

Other characteristics and advantages of the invention will be better understood from a reading of the following description of actual embodiments.

A smoke-producing pyrotechnical composition contains in principle the following components:

a sublimable organic coloring substance which produces a colored smoke by its change of state, an oxidizing system a product serving as binder and fuel between oxidizing agents, coloring substance, and various additives and controlling the velocity of the reaction.

various possible additives such as a hardening agent for the binder or a wetting agent to facilitate the mixing, a gas generator cooling agent, and a stabilizer.

These components are generally all mixed together in order to form a compact unit packed in a can which permits storage and subsequent handling.

The nature of the binder, of the oxidizing agent, and of certain additives is determinative with respect to the effectiveness of the result sought, for a coloring substance which is suitably selected.

These basic components determine the emission of colored smokes in accordance with the following parameters:

minimum temperature at which the oxidizing system is operative, maximum temperature withstood by the resin, maximum temperature withstood by the coloring substance, possible reaction between the coloring substance and the resin, inhibiting its polymerization.

As a matter of fact, when oxidizing agents selected from the group of nitrates, chlorates and perchlorates are used by themselves, the reaction temperature is at least about 400° C., which is too high to preserve the coloring substance. The latter is unstable and most of the time is destroyed to too great an extent for the smoke-producing composition to be able to produce smoke of proper quantity and quality, the colored effect being perceived only slightly if at all.

Furthermore, the customary resins of the type of Araldite, Polyester and Acrylic—cited by way of illustration and not of limitation—are very stable to heat and do not permit the easy sublimation of the coloring substance.

It is also necessary to consider the residues left by the combustion of the resins. If they are too abundant and compact, they cause the occlusion of the coloring substance, that is to say the coating of it by the resin.

For the selection of the binder and of the coloring substance it is advisable to study the possibilities of reaction between them; thus it is better not to choose a polyester or an acrylic. The choice of the binder must also take into account the oxidizing agent; thus it is necessary to exclude acid binding agents.

Furthermore it is to be noted that the role of the guanidine nitrate is to lower the decomposition temperature of the chlorate in order to avoid the thermal degradation of the coloring substance. Thus the oxidizing system obtained reacts at a temperature below the decomposition temperature of the chlorate alone in a range from about 190° C. to 300° C. The role of the nitrate is then to catalyze the decomposition of the chlorate.

The selection of the sublimable coloring substance is not in itself a characteristic of the invention. Those which are well known to the man skilled in the art are, added to the said combination (oxidizing agent/fuel/-binder). It is sufficient for the coloring substance to be sublimable at a temperature at which its decomposition velocity is still low. Stated differently, the difference between the sublimation and decomposition temperatures should be as large as possible. By way of illustration, but not of limitation, mention may be made of the yellow, red, orange and green "organol" coloring substances marketed by Pechiney Ugine Kullman.

"Glycidil ether 100" is the brand name which SHELL markets an epoxyaliphatic resin.

Several practical examples of such a composition are given below:

The percentages indicated below are approximate and expressed in weight of each component referred to the total weight of the composition.

In the following examples, the compositions indicated are preferably cast in bomb or cylindrical bodies forming "loaves" of about 95 to $100\times10^{-3}$ m in height and $75\times10^{-3}$ m in diameter, which are initiated, unless otherwise indicated, at their upper part by a conventional ignition composition (having a base of silicon and copper oxide). The diameter of the outlet orifice of the smoke conduit is preferably $14\times10^{-3}$ meters. Of course these figures must be considered as merely an example of the invention without limitative character.

EXAMPLE I (1) composition for yellow smoke:

| | |
|---|---|
| $KClO_3$ | 21,5% |
| Guanidine nitrate | 16,5% |
| Organol yellow A.D.E. | 33% |
| Glycidil ether 100 | 19,5% |
| Glycol | 7% |
| Hardener HY 938 | 2,5% (aliphatic ethanolamine) |

(2) Experimentation:

0.510 kg of this composition was used, cast as previously mentioned, and upon firing there was obtained a large production of smoke of excellent yellow color lasting for 240 to 270 seconds, the average rate of combustion being about 3.3 to $4.16\times10^{-4}$ m.sec$^{-1}$.

EXAMPLE II (1) Composition for green smoke:

| | | | |
|---|---|---|---|
| $KClO_3$ | 17% | | |
| Guanidine nitrate | 18% | $Fe_2O_3$ | 30% |
| Catalyst (oxides) | 2% | $MnO_2$ | 40% |
| Green for thermoplast | 28% | CuO | 15% |
| Organol yellow | 8% | NiO | 15% |
| Glycidil ether 100 | 17.6% | | |
| Glycerol | 7% | | |

-continued

| | |
|---|---|
| Hardener HY 938 | 2.4% |

(2) Experimentation:

There were used 0.670 kg of this composition, cast as previously mentioned, obtaining upon firing a large volume of smoke of good green color lasting for about 300 seconds, the average rate of combustion being about 3.3 to $4.16\times10^{-4}$ m.sec$^{-1}$.

EXAMPLE III (1) Composition for red smoke:

| | |
|---|---|
| $KClO_3$ | 17.3% |
| Guanidine nitrate | 25% |
| Organol red J | 31.8% |
| Glycidil ether 100 | 17.2% |
| Glycerol | 6.8% |
| Hardener HY 938 | 1.9% |

(2) Experimentation:

0.725 kg of this composition was used, cast as previously, with the sole exception that the orifice of the outlet conduit has a diameter of $16\times10^{-3}$ meters and upon firing there was obtained a smoke of a good red color lasting for 240 seconds, the average rate of combustion being about $5\times10^{-4}$ meters. sec$^{-1}$.

EXAMPLE IV (1) Composition for red smoke:

| | | | |
|---|---|---|---|
| $KClO_3$ | 14.2% | | |
| Guanidine nitrate | 20% | $Fe_2O_3$ | 30% |
| Catalyst (oxides) | 1.8% | $MnO_2$ | 40% |
| Organol vermillon | 39% | CuO | 15% |
| Glycidil ether 100 | 16.5% | NiO | 15% |
| Glycerol | 6.4% | | |
| Hardener HY 938 | 2.1% | | |

(2) Experimentation:

0.600 kg of this composition was used cast into a recessed cylinder primed at its base, the diameter of the orifice of the outlet conduit being $16\times10^{-3}$ m, and upon firing there was obtained a large volume of smoke of a very red color for 210 sec., the average rate of combustion being about 1.66 to $2.5\times10^{-4}$ m.sec$^{-1}$.

EXAMPLE V (1) Composition for yellow smoke:

| | |
|---|---|
| $KClO_3$ | 20% |
| Guanidine nitrate | 18% |
| "organol yellow" coloring substance | 34% |
| Polyglycidic ether of propane triol (D.G.E. 100) | 12.4% |
| Diglycidic ether of 1,4-butanediol (E.D.G. 1,4 B.D.) | 12% |
| Hardener formed of an aliphatic ethanolamine (HY 938) | 3.6% |

(2) Experimentation:

This composition which forms a cylindrical charge filling a light-alloy tube of a length of $210\times10^{-3}$ m, a thickness of $1\times10^{-3}$ m and an outside diameter of $50\times10^{-3}$ m, all contained within a wooden body provided with an expansion chamber and an outlet orifice of a diameter of $14\times10^{-3}$ meters, gives a good uniform discharge of an excellent yellow smoke for a period of 420 seconds, for 0.450 kg of composition.

EXAMPLE VI (1) Composition for red smoke:

| | | |
|---|---|---|
| $KClO_3$ | | 13% |
| Guanidine nitrate | | 26% |
| "organol red" coloring substance | | 32% |
| D.G.E. 100 | See | 13.5% |
| E.D.G. 1,4 B.D. | Example | 11.8% |
| HY 938 | V | 3.7% |

(2) Experimentation:

This composition which forms a hollow cylindrical charge of an outside diameter of $75\times10^{31}$'m, an inside diameter of $25\times10^{-3}$ m and a height of $90\times10^{-3}$ m, placed in a stainless steel body provided with an expansion chamber and an outlet conduit of a diameter of $18\times10^{-3}$ meters, gives a good emission of an abundant red smoke of good to very good color quality for a period of about 330 seconds, for 0.500 kg of composition.

EXAMPLE VII (1) Composition for yellow smoke:

| | |
|---|---|
| $KClO_3$ | 14% |
| Guanidine nitrate | 20% |
| "organol yellow" coloring substance | 40% |
| D.G.E. 100 (see Example V.1) | 12% |
| Monoglycidic ether of butanediol (E.G.B.) | 11% |
| Aliphatic polyamine hardener (H.Y. 951) | 3% |

(2) Experimentation:

This composition which forms a cylindrical charge of a diameter of $32\times10^{-3}$ and a length of about $80\times10^{-3}$ m is placed in a simple tubular metal body open to the free air. Upon operation there is obtained a slow and uniform discharge of a yellow smoke of excellent color for a period of more than 420 seconds, for 0.100 kg of composition.

EXAMPLE VIII (1) Composition for yellow smoke:

| | |
|---|---|
| $KClO_3$ | 21% |
| Guanidine nitrate | 18% |
| "organol yellow" coloring substance | 34% |
| D.G.E. 100 (See Example V.1) | 16.5% |
| Glycidol | 6.5% |
| H.Y. 938 (See Example V.1) | 4% |

(2) Experimentation:

This composition which forms a charge similar to that of example VII and is placed under indentical conditions gives a good production of smoke of an excellent yellow color for a period of about 180 seconds, for 0.100 kg of composition.

EXAMPLE IX (1) Composition for yellow smoke:

| | | |
|---|---|---|
| Sodium chlorate | | 18% |
| Guanidine nitrate | | 20% |
| "organol yellow" coloring substance | | 34% |
| D.G.E. 100 | see Ex. V.I. | 12.4% |
| E.D.G. 1,4 BD | | 12% |
| HY 938 | | 3.6% |

(2) Experimentation:

This composition which operates under conditions similar to those of example VIII gives a good emission of yellow smoke for a period of about 180 seconds, for 0.100 kg of composition.

In examples V,VI,VII,VIII and IX the charges are initiated at the upper end by a conventional priming composition having a base of copper oxide and silicon.

Of course the examples given are not limitative and a change with respect to the proportions of the components, the selection of the coloring substance, as well as the selection of the resins falling within the same chemical as stipulated in the general description does not go beyond the scope of the compositions falling within the invention.

MANNER OF MANUFACTURE

In the case of the catalyzed compositions, the catalyst is prepared in advance by mixing powdered metal particles screened to a size of $80\times10^{-6}$ m.

The catalyst is then mixed with the chlorate (mixture screened in a bottle by the TURBULA process).

In order to prepare the composition, the chlorate (or the chlorate-catalyst mixture), the guanidine nitrate, and the coloring substance, added together, are first of all mixed (TURBULA process).

Separately the glycidil ether+glycerine or glycol+-hardener mixture is prepared and the preceding mixture is poured into the liquid. Mixing is effected for several moments until a homogeneous paste is obtained.

A variant will consist in introducing the chlorate (possibly with catalyst) into the glycidil ether+glycerol or glycol+hardener, then the guanidine nitrate, and then the coloring substance.

Of course various modifications may be made in the compositions and manner of operation which have just been described without going beyond the scope of the invention, they having been described solely by way of illustration and not of limitation.

I claim:

1. A castable colored smoke-producing pyrotechnic composition which burns at 190° to 300° C., comprising a synthetic resin, an oxidizing agent, and a sublimable organic coloring substance, wherein said resin decomposes at a temperature between 190° and 300° C. and said oxidizing agent is formed of the combination of two compounds, the first compound being a potassium or sodium chlorate and the second compound being guanidine nitrate.

2. The composition of claim 1, wherein said composition contains at least one metallic oxide selected from the group consisting of manganese, ferric, copper, and nickel oxides, to catalyze decomposition of chlorate.

3. The composition of claim 2 wherein said resin comprises an epoxyaliphatic resin.

4. The composition of claim 3 containing no solvent for said epoxyaliphatic resin.

5. The composition of claim 3 or claim 4 wherein said epoxyaliphatic resin comprises the condensation product of epoxypropanol with an aliphatic polyalcohol.

6. The composition of claim 5 wherein said aliphatic polyalcohol is selected from the group consisting of ethane diol and propane triol.

7. The composition of claim 5 further comprising an amine hardener for said epoxyaliphatic resin.

8. The composition of claim 3 wherein said epoxyaliphatic resin is the polymerization product of a diglycidic ether of an aliphatic dialcohol.

9. The composition of claim 8 wherein said diglycidic ether of an aliphatic dialcohol is the diglycidic ether of 1,4-butanediol.

10. The composition of claim 5 wherein said epoxyaliphatic resin is blended with the diglycidic ether of 1,4-butanediol before polymerization.

11. The composition of claim 10 further containing an organic plasticizing agent for said epoxyaliphatic resin.

12. The composition of claim 11 wherein said organic plasticizing agent is selected from the group consisting of ethane diol and propane triol.

13. A castable colored smoke-producing pyrotechnic composition comprising, a. about 10 to about 25% of potassium chlorate or sodium chlorate,
b. about 10 to about 30% of guanidine nitrate,
c. about 10 to about 35% of a synthetic epoxyaliphatic resin that decomposes at a temperature between 190° and 300° and is the condensation reaction product of epoxypropanol and an aliphatic polyalcohol, said epoxyaliphatic resin being blended with the diglycidic ether of 1,4 butanediol before polymerization and containing an amine hardener for said epoxyaliphatic resin,
d. up to about 15% of an organic plasticizer for said resin,
e. about 25 to about 50% of a sublimable organic coloring substance, and,
f. up to about 5% of at least one metallic oxide catalyst, the percentages being by weight of component based upon the total weight of said composition.

14. The composition of claim 13 wherein said aliphatic polyalcohol is selected from the group consisting of ethane diol and propane triol.

15. A pyrotechnic method of producing colored smokes comprising burning at a temperature of from 190° C. to 300° C. a castable colored smoke-producing pyrotechnic composition comprising, a. about 10 to about 25% of potassium chlorate or sodium chlorate,
b. about 10 to about 30% of guanidine nitrate,
c. about 10 to about 35% of a synthetic epoxyaliphatic resin that decomposes at a temperature between 190° and 300° and is the condensation reaction product of epoxypropanol and an aliphatic polyalcohol, said epoxyaliphatic resin being blended with the diglycidic ether of 1,4 butanediol before polymerization and containing an amine hardener for said epoxyaliphatic resin,
d. up to about 15% of an organic plasticizer for said resin,
e. about 25 to about 50% of a sublimable organic coloring substance, and,
f. up to about 5% of at least one metallic oxide catalyst, the percentages being by weight of component based upon the total weight of said composition.

16. A process for the sublimation of a coloring substance in a castable smoke-producing pyrotechnic composition comprising a synthetic resin, an organic coloring substance, and an oxidizing agent comprising undertaking burning at a temperature between 190° and 300° C., and wherein said oxidizing agent is a combination of (1) potassium chlorate or sodium chlorate and (2) guanidine nitrate.

17. The process of claim 16 wherein said synthetic resin is an epoxyaliphatic resin.

* * * * *